US006923437B2

(12) United States Patent
Huang et al.

(10) Patent No.: US 6,923,437 B2
(45) Date of Patent: Aug. 2, 2005

(54) APPARATUS AND METHODS FOR FEEDING SHEETS OF MEDIA TO A MEDIA PROCESSOR

(75) Inventors: Yuchi Huang, Potomac, MD (US); Brian J. Loch, Sterling, VA (US); Joseph C. Brown, Lovettsville, VA (US); Rodger M. Hopkins, Warrenton, VA (US); Edward W. Bindon, Fairfax, VA (US); John S. Baumgartner, Reston, VA (US)

(73) Assignee: VIDAR Systems Corporation, Herndon, VA (US)

( * ) Notice: Subject to any disclaimer, the term of this patent is extended or adjusted under 35 U.S.C. 154(b) by 181 days.

(21) Appl. No.: 10/304,953

(22) Filed: Nov. 27, 2002

(65) Prior Publication Data

US 2004/0100010 A1 May 27, 2004

(51) Int. Cl.[7] ..... B65H 5/22
(52) U.S. Cl. ..... 271/4.03
(58) Field of Search ..... 271/4.03

(56) References Cited

U.S. PATENT DOCUMENTS 5,678,815 A * 10/1997 Sheng ..... 271/10.13
5,921,539 A * 7/1999 Westcott et al. ..... 271/10.03
6,105,954 A * 8/2000 Magee et al. ..... 271/10.03
6,126,160 A * 10/2000 Ebert et al. ..... 271/10.03
6,151,478 A * 11/2000 Katsuta et al. ..... 399/372

* cited by examiner

*Primary Examiner*—Donald P. Walsh
*Assistant Examiner*—Kenneth W. Bower
(74) *Attorney, Agent, or Firm*—Finnegan, Henderson, Farabow, Garrett & Dunner LLP

(57) ABSTRACT

Apparatus for feeding sheets of media to a media processor may include a take-away roller for engaging a first sheet of media. It may further include a first sensor for detecting a movement of the first sheet of media past the take-away roller. The apparatus may include a feed roller and a second sensor for detecting a movement of the first sheet of media past the feed roller. The apparatus may further include a second motor for driving the feed roller. Also, the apparatus may include an ejection roller, a third sensor for detecting the movement of the first sheet of media past the ejection roller, and a third motor for driving the ejection roller.

3 Claims, 10 Drawing Sheets

100

100

APPARATUS AND METHODS FOR FEEDING SHEETS OF MEDIA TO A MEDIA PROCESSOR

BACKGROUND OF THE INVENTION

I. Field of the Invention

The present invention generally relates to the field of media processors, such as scanners and film digitizers. More particularly, the invention relates to apparatus and methods for feeding sheets of media to a media processor.

II. Background and Material Information

Media processors, such as scanners and digitizers are used to process sheets of media, such as X-ray films. A media processor typically includes a feed mechanism to feed one sheet of media at a time to the media processor. Typically, a second sheet of media is not fed until a first sheet of media fed to the media processor has been processed. Further, the sheets of media are kept in a tray, which may have several sheets of media.

Because of the increasing number of sheets of media, such as X-ray films, that must be scanned or digitized, the media processor must have a high throughput. The media processor's throughput is a function of several factors, including the speed at which a sheet of media can be fed through the media processor. Typically, an image sensor array or a similar device is used to acquire the image(s) located on the sheet of media. Inherent physical and electrical constraints dictate the time for which a part of the sheet of media needs exposure to a light source and the image sensor array. Accordingly, there are serious constraints upon increasing the throughput of a media processor by simply increasing the speed.

The throughput of a media processor, however, is also affected by other factors. For example, as discussed above, typically a second sheet of media is not fed until the first sheet of media has been processed by the media processor. This delay in feeding the second sheet of media seriously degrades the throughput of a media processor. Merely increasing the speed of processing of the sheet of media by the media processor does not solve the problem.

Accordingly, there is a need for improved methods and apparatus for improving the throughput of media processors, such as scanners and film digitizers.

SUMMARY OF THE INVENTION

Apparatus and methods consistent with embodiments of the present invention improve the throughput of a media processor, such as a scanner and a digitizer, by continuously feeding media to the media processor.

According to one aspect of the invention, a method for feeding a sheet of media is provided. The method may include feeding a first sheet of media to the media processor using a feed mechanism. The method may further include, upon detecting a movement of a trailing edge of the first sheet of media past the feed mechanism, feeding a second sheet of media to the media processor.

According to another aspect of the invention, a method for feeding sheets of film to a film digitizer is provided. The method may include engaging a first sheet of film using a take-away roller from a tray containing sheets of film. The method may further include feeding the first sheet of film to the film digitizer. Moreover, the method may include engaging a second sheet of film using the take-away roller from the tray containing the sheets of film. Additionally, the method may include feeding the second sheet of film to the film digitizer.

According to a yet another aspect of the invention, an apparatus for scanning film is provided. The apparatus may include a take-away roller for engaging a first sheet of film and a feed roller for feeding the sheet of film. Also, the apparatus may include a sensor for detecting a trailing edge of the first sheet past the take-away roller.

According to still another aspect of the invention, a method for feeding a sheet of media to a media processor is provided. The method may include feeding a first sheet of media using a feed mechanism. Also, the method may include feeding a second sheet of media to the media processor after a predetermined time, wherein the predetermined time is selected to maximize a throughput of the media processor.

According to another aspect of the invention, an apparatus for feeding sheets of media is provided. The apparatus may include a take-away roller for engaging a first sheet of media. It may further include a first sensor for detecting a movement of the first sheet of media past the take-away roller. The apparatus may further include a first motor for driving the take-away roller. Additionally, the apparatus may include a feed roller and a second sensor for detecting a movement of the first sheet of media past the feed roller. The apparatus may further include a second motor for driving the feed roller. The apparatus may also include an ejection roller and a third sensor for detecting a movement of the first sheet of media past the ejection roller. The apparatus may further include a third motor for driving the ejection roller.

According to yet another aspect of the invention, a method for feeding a sheet of media to a media processor is provided. The method may include engaging a first sheet of media using a take-away roller being driven by a first motor. The method may further include feeding the first sheet of media using a feed roller being driven by a second motor. Further, the method may include upon detecting a trailing edge of the first sheet of media past the feed roller, feeding the second sheet of media and ejecting the first sheet of media using an ejection roller when the first sheet of media has been digitized.

According to still another aspect of the invention, a method for improving throughput of a media processor is provided, the method may include engaging a first sheet of media using a take-away roller being driven by a first motor. The method may further include feeding the first sheet of media using a feed roller being driven by a second motor. The method also may include, after a first predetermined time engaging a second sheet of media using the take-away roller, wherein the first predetermined time is selected to maximize the throughput of the media processor. The method may further include, after a second predetermined time, feeding the second sheet of media, wherein the second predetermined time is selected to maximize the throughput of the media processor. Additionally, the method may include ejecting the first sheet of media using an ejection roller being driven by a third motor.

According to another aspect of the invention, a method for improving throughput of a media processor having a first zone, a second zone, and a third zone is provided. The method may include processing sheets of media through the first zone, the second zone, and the third zone of the media processor. The method may further include optimizing the throughput of the media processor without increasing a rate of the processing of the sheets of media for each one of the first zone, the second zone, and the third zone, respectively.

Both the foregoing general description and the following detailed description are exemplary and are intended to provide further illustration and explanation of the embodiments of the invention as claimed.

BRIEF DESCRIPTION OF THE DRAWINGS

The accompanying drawings, which are incorporated in and constitute a part of this specification, illustrate various embodiments and aspects of the present invention. In the drawings.

DETAILED DESCRIPTION

Apparatus and methods consistent with embodiments of the present invention relate to feeding at least one sheet of media to a media processor. Consistent with apparatus and methods of the present invention throughput of a media processor may be improved.

Figure 1A:
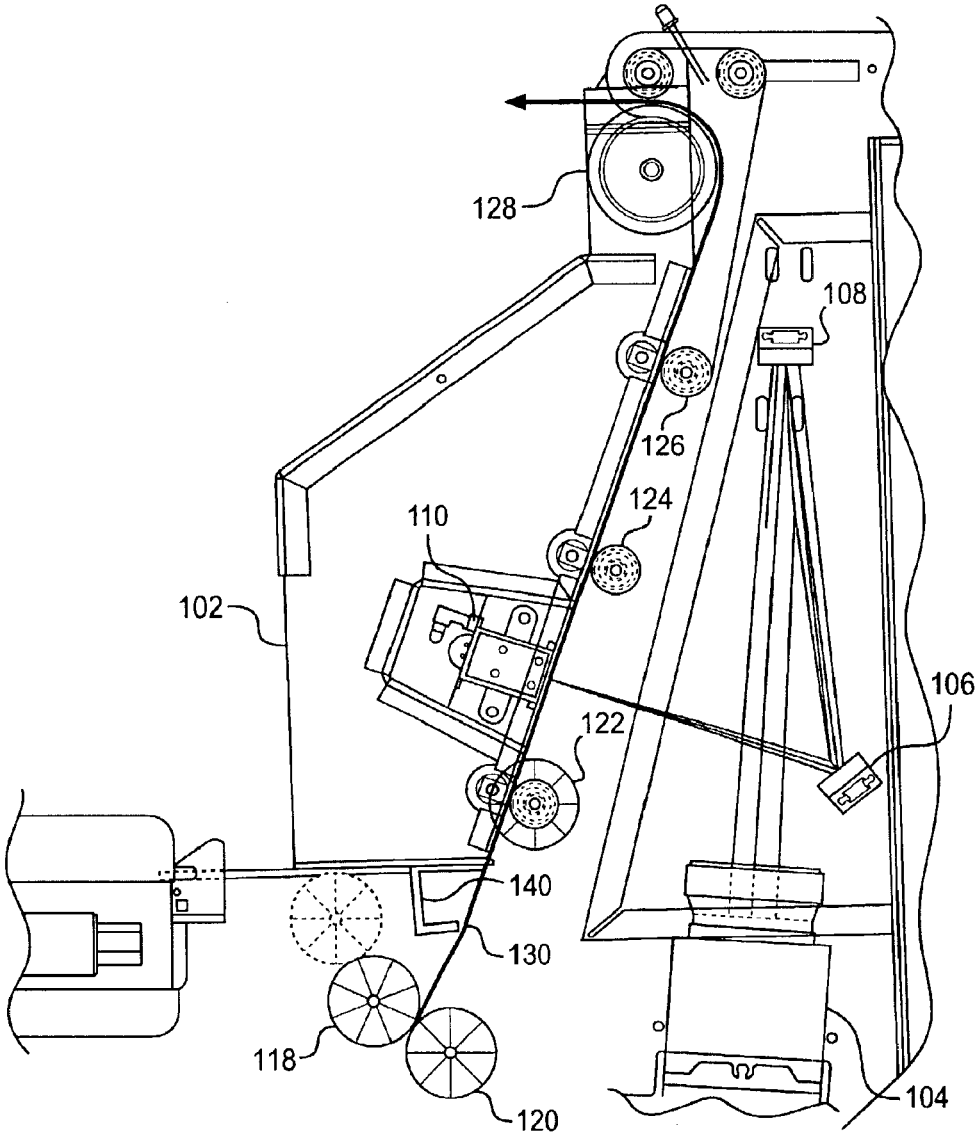
FIG. 1A shows an exemplary media processor consistent with embodiments of the present invention.

FIG. 1A shows an exemplary media processor consistent with embodiments of the present invention. The exemplary media processor may include an external housing 102. Although not shown, the media processor may further include an internal housing. The media processor of FIG. 1A may include a camera 104, at least one mirror (for example, 106 and 108) to redirect light emitting from a light source 110. The camera 104 may include a light sensitive array, such as a charge coupled device (CCD) array. Each light sensitive element on the CCD array may register the intensity of light corresponding to an area forming a pixel, for example. An intensity value corresponding to each pixel may be transferred to a processor (not shown), which may generate an image of the sheet of media based on the intensity values. Besides a CCD array, other types of sensor arrays, such as CMOS sensor arrays may be used. Indeed, any other type of sensor array that can convert light intensity, for example, to a data value, may be used. The camera 104 may further include a lens assembly to focus light onto the CCD array, for example. The light source 110 may be an array of incandescent bulbs, an array of light emitting diodes (LEDs), or any other light source.

Each embodiment of the media processor may include a processor, such as a central processing unit (CPU) (not shown), which may, when programmed, interact with the various sensors and motors to control the behavior of the motors based on input from the sensors. The programmed CPU may also generate signals to the motors causing them to stop or move based on stored data values, such as a predetermined time after which a second sheet of media may be fed to the media processor.

The media processor may further include a mechanism including at least one roller to feed a sheet of media to the media processor. In one embodiment, a take-away roller 118 may be used to engage a sheet of media. Once engaged, the sheet of media may be fed, using, for example, at least one feed roller 122. Once processed by the media processor, the sheet of media may be ejected using at least one ejection roller 128.

In one embodiment, take-away roller 118 may form a nip with an idler roller 120 to engage a sheet of media 130. Further, take-away roller 118 may be driven by a motor (not shown). Also, as shown with broken lines in FIG. 1A, take-away roller 118 may retract to a resting position once a sheet of media, for example, has been engaged by the feed roller. Additionally or alternatively, idler roller 120 may retract. Similarly, the idler rollers discussed with respect to the other embodiments of the invention may retract. Alternatively, the take-away rollers may be retractable.

Figure 1B:
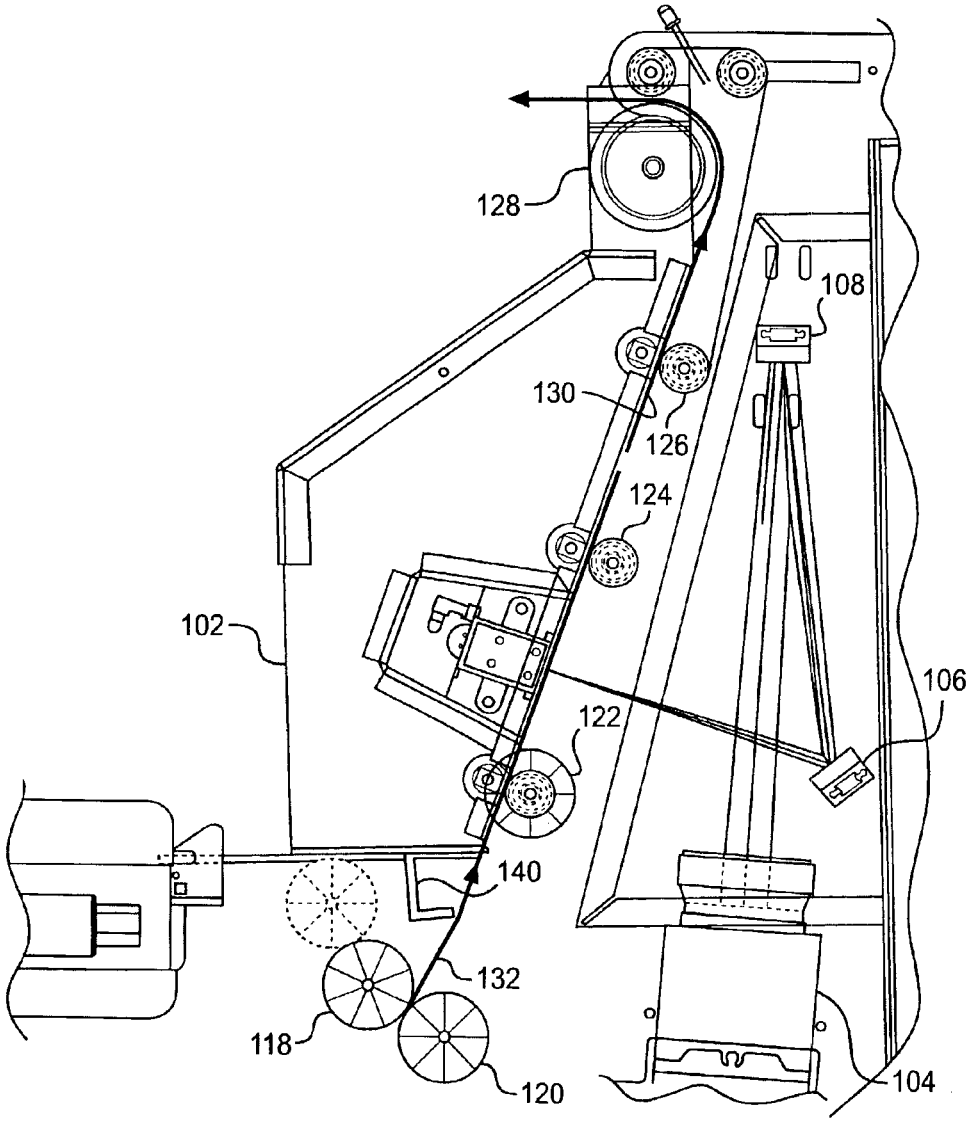
FIG. 1B shows the exemplary media processor with a second sheet of media consistent with embodiments of the present invention.

FIG. 1B shows the exemplary media processor with a second sheet of media consistent with embodiments of the present invention. As shown in FIG. 1B, a first sheet of media may be being ejected, while a second sheet of media (132) is being processed.

Figure 2:
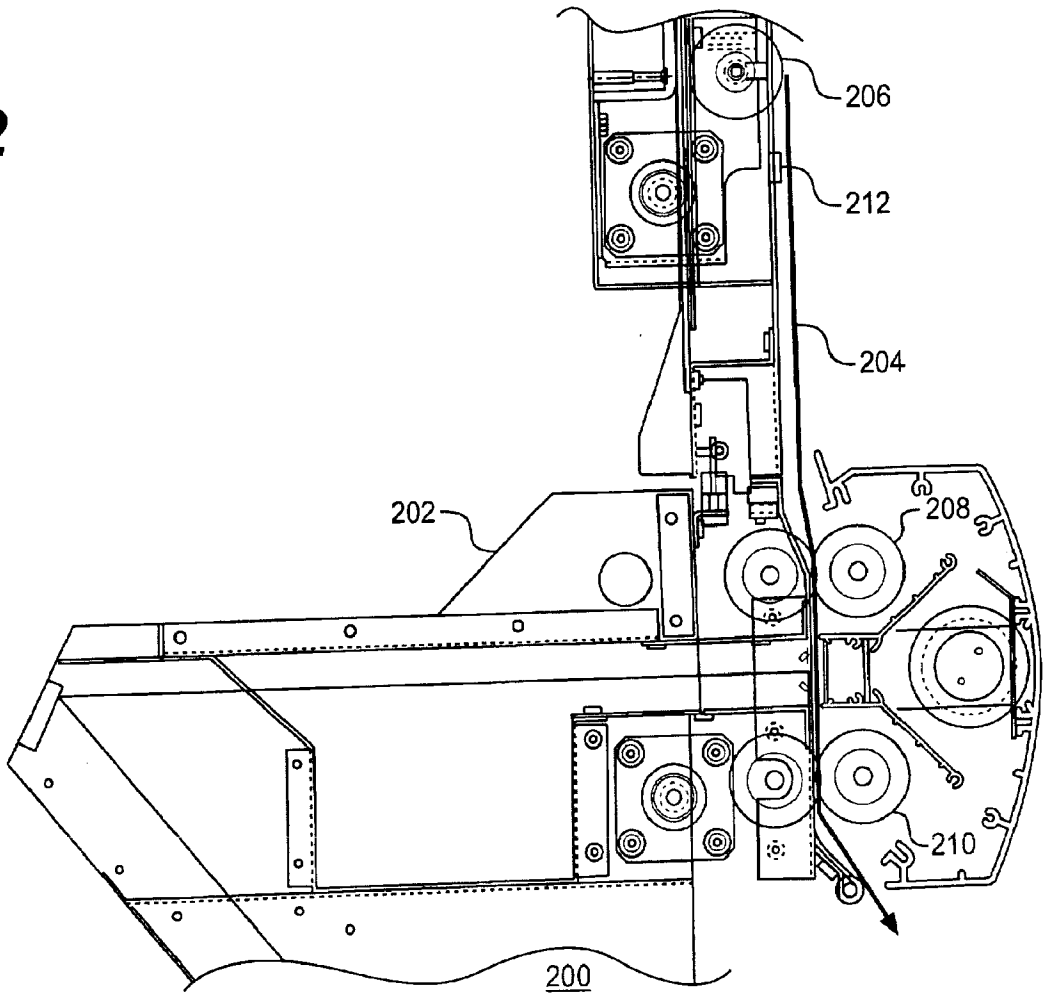
FIG. 2 shows another exemplary media processor consistent with embodiments of the present invention.

FIG. 2 shows another exemplary media processor 200 consistent with embodiments of the present invention. The exemplary media processor 200 may include a housing 202. It may be used to process a sheet of media 204. The sheet of media may be engaged using at least one take-away roller 206. It may further be fed using a feed roller 208 and may be ejected, after being processed, using an ejection roller 210. Each roller may be driven by a single motor (not shown), which may be connected via belts, pulleys, gears, or any other mechanism to impart rotational motion to the rollers. Further, as discussed above, a stepper motor or any other appropriate drive system may be used to drive the rollers. Also, although not shown, each one of these rollers may be driven by a separate motor. Moreover, a sensor 212 may be used to detect a trailing edge of sheets of media. As noted above, the sensor (and the sensors referred to in the other embodiments) may be a photo-detector, a Hall-effect sensor, an opto-electronic sensor, or any other type of sensor capable of detecting an edge of a sheet of media, such as an X-ray film.

Additionally, although not shown, instead of a roller, such as a take-away roller, other mechanisms comprising a wheel, a belt mechanism, a moving chuck, or a rotating chuck may be used.

Figure 3A:
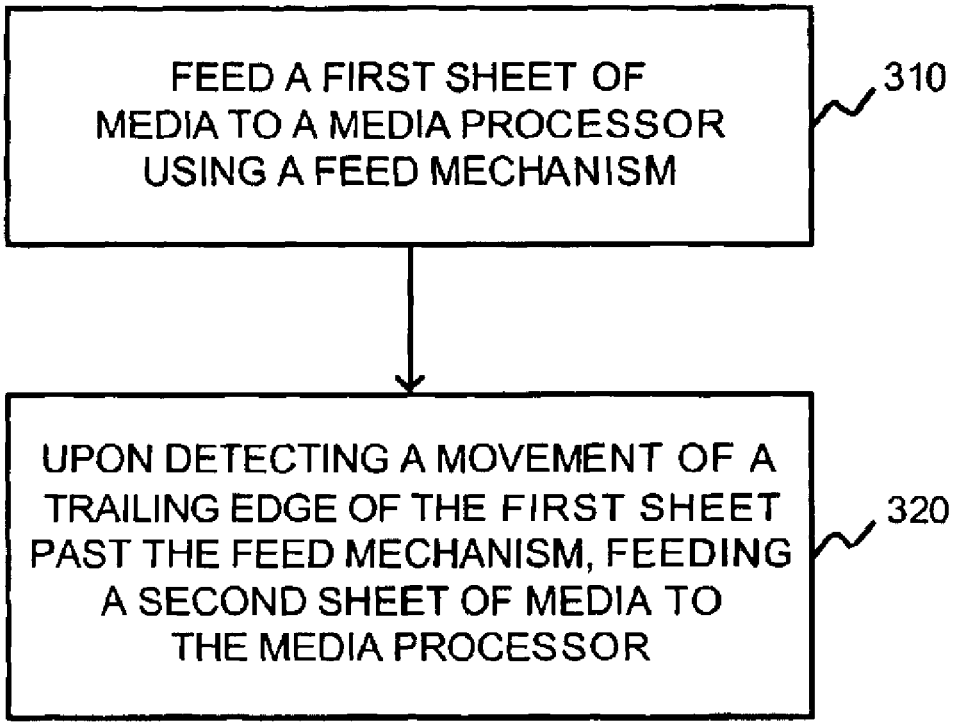
FIG. 3A shows a flowchart of an exemplary method for feeding a sheet of media to a media processor consistent with embodiments of the present invention.

FIG. 3A shows a flowchart of an exemplary method for feeding a sheet of media to a media processor consistent with embodiments of the present invention. The exemplary method may comprise feeding a first sheet of media to the media processor using a feed mechanism (step 310). The term "feed mechanism" as used herein includes, but is not limited to, a take-away roller 118 shown in FIG. 1A. In one embodiment, however, take-away roller 118 may be used in conjunction with an idler roller 120 as a feed mechanism for feeding the sheet to the media processor.

Further, the sheet of media may be a sheet of X-ray film. The sheet of media may also be a sheet of paper, a sheet of transparency, or a sheet of photographic paper.

The method shown in FIG. 3A may further comprise, upon detecting a movement of a trailing edge of the first sheet of media past the feed mechanism, feeding a second sheet of media to the media processor (step 320). In one embodiment, the trailing edge of the first sheet of media may be detected, for example, using a sensor 140, as shown in FIG. 1A. Alternatively, it may be detected using a sensor 212, as shown in FIG. 2. As noted above, the sensor (and the sensors referred to in the other embodiments) may be a photo-detector, a Hall-effect sensor, an opto-electronic sensor, or any other type of sensor capable of detecting an edge of a sheet of media, such as an X-ray film. Also, as used herein, the term "past" includes not only the ordinary meaning of the term past, but also includes a situation where the sheet of media is aligned with the feed mechanism and is not yet past the feed mechanism. In other words, although FIG. 1A depicts sensor 140 located slightly offset from take-away roller 120, sensor 140 may be in the same plane as take-away roller 120.

The method for feeding the sheet of media may further comprise engaging the first sheet of media from a tray (not shown) containing sheets of media. Further, the method may include engaging the second sheet of media from the tray containing sheets of media as well. Also, the method may include staging the first sheet of media. It may also include staging the second sheet of media. In one embodiment, staging may refer to preparing a sheet of media before it is engaged by the take-away roller.

Figure 3B:
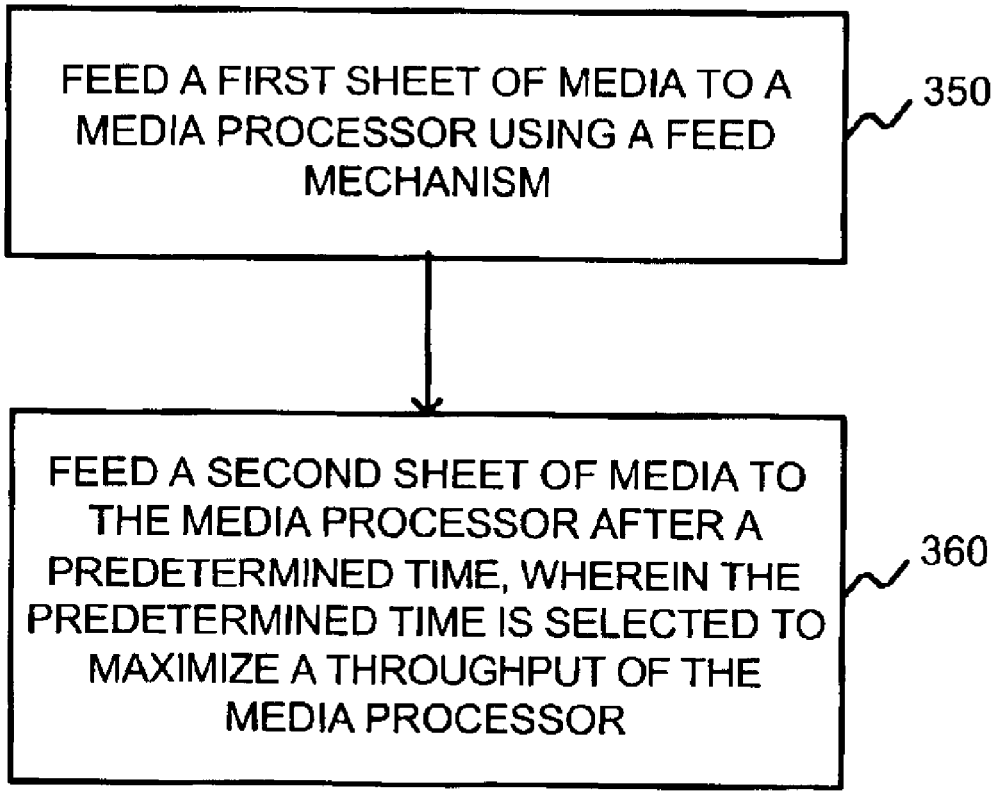
FIG. 3B a flowchart of another exemplary method for continuously feeding a sheet of media to a media processor consistent with embodiments of the present invention.

FIG. 3B shows a flowchart of another exemplary method for feeding a sheet of media to a media processor consistent with embodiments of the present invention. The method may comprise feeding a first sheet of media to the media processor using a feed mechanism (step 350). As noted above, the term "feed mechanism" as used herein refers to a take-away roller 118 shown in FIG. 1A. In one embodiment, however, take-away roller 118 may be used in conjunction with an idler roller 120 as a feed mechanism for feeding the sheet to the media processor. Additionally or alternatively, the take-away roller may be combined with other elements that may comprise together the "feed mechanism." Techniques other than a take-away roller (alone or in combination with an idler roller) may also be used consistent with the meaning of the term "feed mechanism."

The exemplary method shown in FIG. 3B may further comprise feeding a second sheet of media to the media processor after a predetermined time, wherein the predetermined time is selected to maximize a throughput of the media processor (step 360). In one embodiment, the predetermined time may be selected based on a length of a sheet of media and a speed at which the first sheet of media may be fed to the media processor. Additionally, the term "predetermined," as used herein, includes determination of the time based on the feeding of a first sheet of media and then using that determination to control the throughput of the media processor. Therefore, even when the length of a sheet of media is not known in advance, the length of the sheet of media may be determined in an initial process and then used to control the feeding of other sheets of media later.

Figure 4:
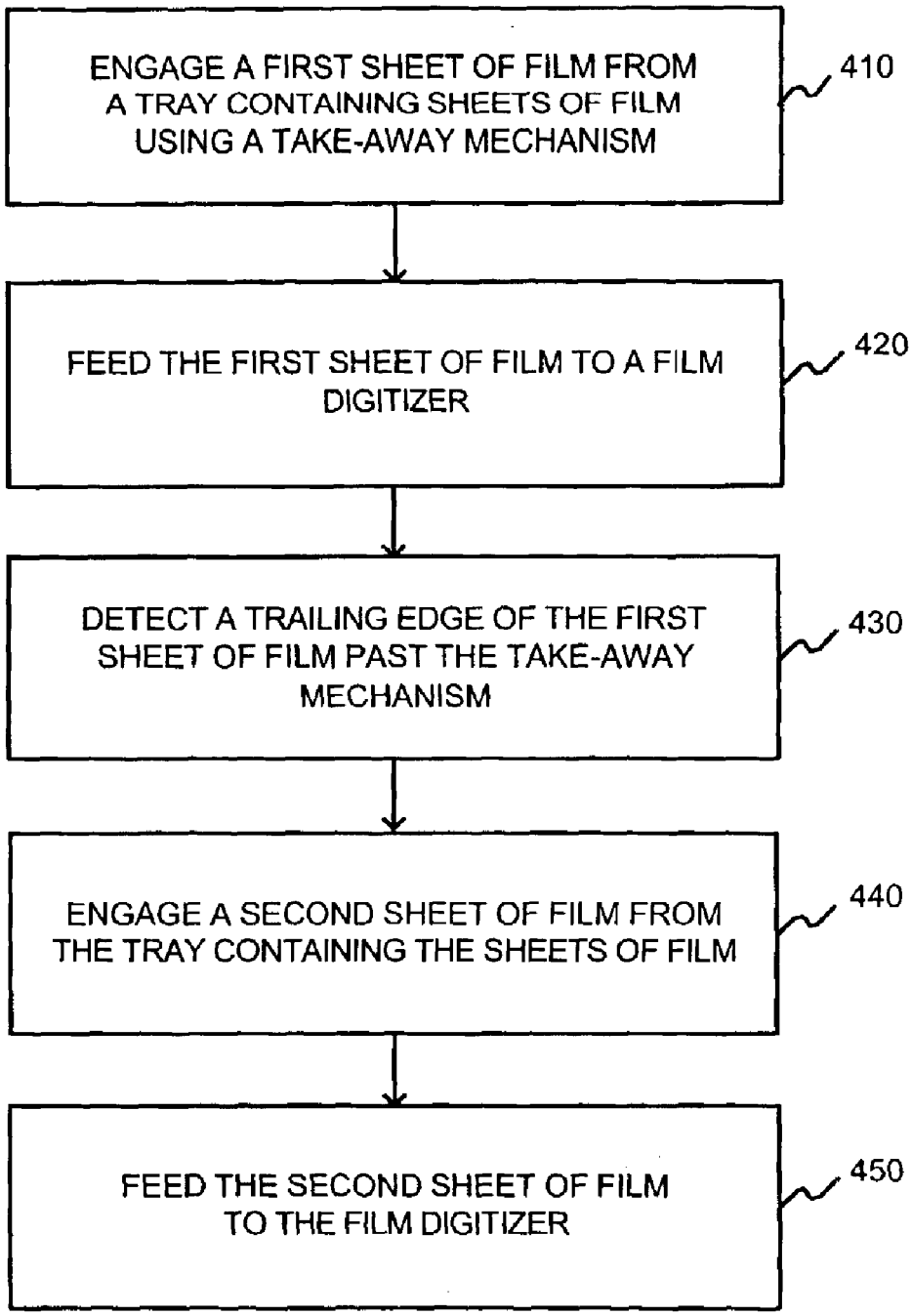
FIG. 4 shows a flowchart of another exemplary method for feeding sheets of film to a film digitizer consistent with embodiments of the present invention.

FIG. 4 shows a flowchart of another exemplary method for feeding sheets of film to a film digitizer consistent with embodiments of the present invention. The exemplary method may include engaging a first sheet of film, using a take-away mechanism, for example, a take-away roller, from a tray containing sheets of film (step 410). The take-away mechanism may include, but is not limited to, a roller, a wheel, a belt mechanism, a moving chuck, or a rotating chuck.

Next, the method may include feeding the first sheet of film to the film digitizer (step 420). The first sheet of film may be fed using a feed mechanism, which may include, but is not limited to, a roller, a wheel, a belt mechanism, a moving chuck, or a rotating chuck. In one embodiment, the first sheet of film may be fed using at least one feed roller (122 of FIGS. 1A and 208 of FIG. 2, for example).

Further, the method corresponding to the flowchart shown in FIG. 4 may include detecting a trailing edge of the first sheet of film past the take-away mechanism (step 430). In one embodiment, the trailing edge of the first sheet of media may be detected, for example, using a sensor 140 or 212. Also, as used herein, the phrase "past the take-away mechanism" includes not only the ordinary meaning of the term past, but also includes a situation where the sheet of media is aligned with the take-away mechanism and thus the sheet of media is not yet past the take-away mechanism. In other words, although FIG. 1A depicts sensor 130 located slightly offset from take-away roller 120, sensor 130 may be in the same plane as take-away roller 120.

Moreover, the method may further include engaging a second sheet of film using the take-away mechanism from the tray containing the sheets of film (step 440). Also, the method may further include feeding the second sheet of film to the film digitizer (step 450). The method may further include staging the first sheet. Also, the method may include staging the second sheet. In one embodiment, staging may refer to preparing a sheet of media before it is engaged by the take-away mechanism.

Figure 5:
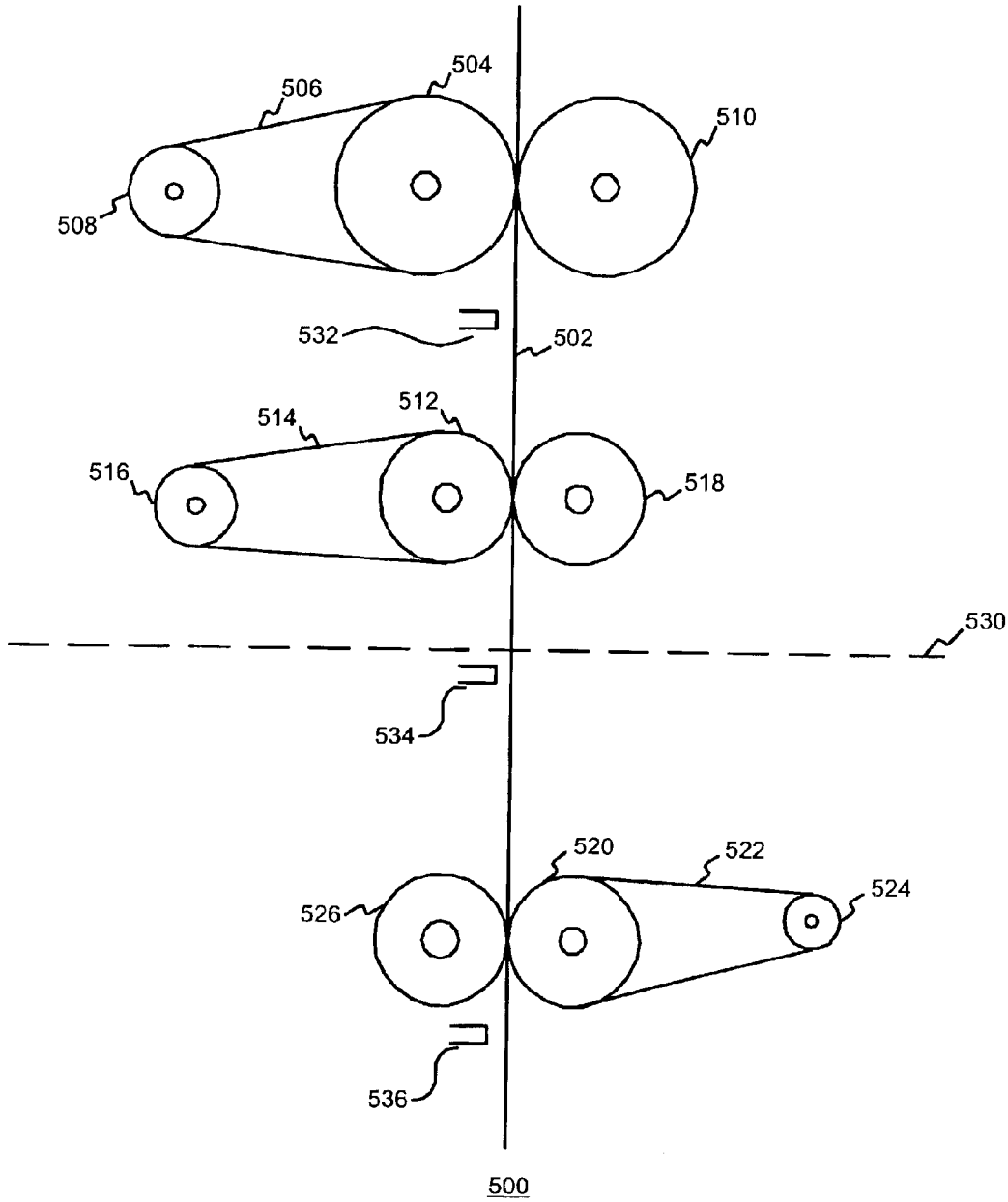
FIG. 5 shows a schematic diagram illustrating an exemplary apparatus for feeding sheets of media consistent with embodiments of the present invention.

FIG. 5 shows a schematic diagram illustrating an apparatus 500 for feeding sheets of media consistent with embodiments of the present invention. The exemplary apparatus may be used to feed at least one sheet of media 502. The exemplary apparatus 500 may include a take-away roller 504 coupled via a belt 506 to a first motor 508 for driving take-away roller 504. The first motor may be a stepper motor or any other mechanism to impart a rotational motion to take-away roller 504. Other components such as gears may also be used, alone or in conjunction with belt 506, to couple first motor 508 to take-away roller 504. An idler roller 510 may be used to form a nip (to engage a sheet of media) between take-away roller 504 and idler roller 510.

The exemplary apparatus 500 may further include a feed roller 512 coupled via a belt 514 to a second motor 516. The second motor may be a stepper motor or any other mechanism to impart a rotational motion to feed roller 512. Other components such as gears may also be used, alone or in conjunction with belt 514, to couple second motor 516 to feed roller 512. An idler roller 518 may be used to form a nip (to engage a sheet of media) between feed roller 512 and idler roller 518. Although not shown, additional feed rollers may also be used consistent with other embodiments of the present invention. Additionally, each of the feed rollers may be coupled to second motor 516 or may be coupled to another motor.

Further, the exemplary apparatus illustrated in FIG. 5 may include an ejection roller 520 coupled via a belt 522 to a third motor 524. The third motor may be a stepper motor or any other mechanism to impart a rotational motion to ejection roller 520. Other components such as gears may also be used, alone or in conjunction with belt 522, to couple third motor 524 to ejection roller 520. An idler roller 526 may be used to form a nip (to engage a sheet of media) between ejection roller 520 and idler roller 526. Although not shown, additional ejection rollers may also be used consistent with other embodiments of the present invention. Additionally, each of the ejection rollers may be coupled to third motor 524 or may be coupled to another motor.

Further, as shown in FIG. 5, one or more sensors may be used to track the progress of a sheet of media from the time it is engaged by a take-away roller to the time it is ejected by an ejection roller. For example, a first sensor 532 may detect a movement of a sheet of media 502, such as a sheet of film, past the take-away roller 504. Also, as used herein the term "past" includes not only the ordinary meaning of the term past, but also includes a situation where the sheet of media is aligned with take-away roller 504 and is not yet past take-away roller 504. In other words, although FIG. 5 depicts first sensor 532 located slightly downstream from take-away roller 504, first sensor 532 may be in the same plane as take-away roller 504.

The exemplary apparatus may further include a second sensor 534 to detect a movement of the sheet of media past an image line 530. The image line is a line that the camera (104 of FIG. 1A, for example) sees while processing (scanning or digitizing, for example) the sheet of media. Also, as used herein the term "past" includes not only the ordinary meaning of the term past, but also includes a situation where the sheet of media is aligned with image line 530 and is not yet past image line 530. In other words, although FIG. 5 depicts second sensor 534 located slightly downstream from image line 530, second sensor 534 may be in substantially the same plane as image line 530.

Moreover, the exemplary apparatus of FIG. 5 may further include a third sensor 536 to detect a movement of the first sheet of media past the ejection roller 520. Additionally, as used herein the term "past" includes not only the ordinary meaning of the term past, but also includes a situation where the sheet of media is aligned with the and is not yet past ejection roller 520. In other words, although FIG. 5 depicts third sensor 536 located slightly downstream from ejection roller 520, third sensor 536 may be in the same plane as ejection roller 520.

Figure 6:
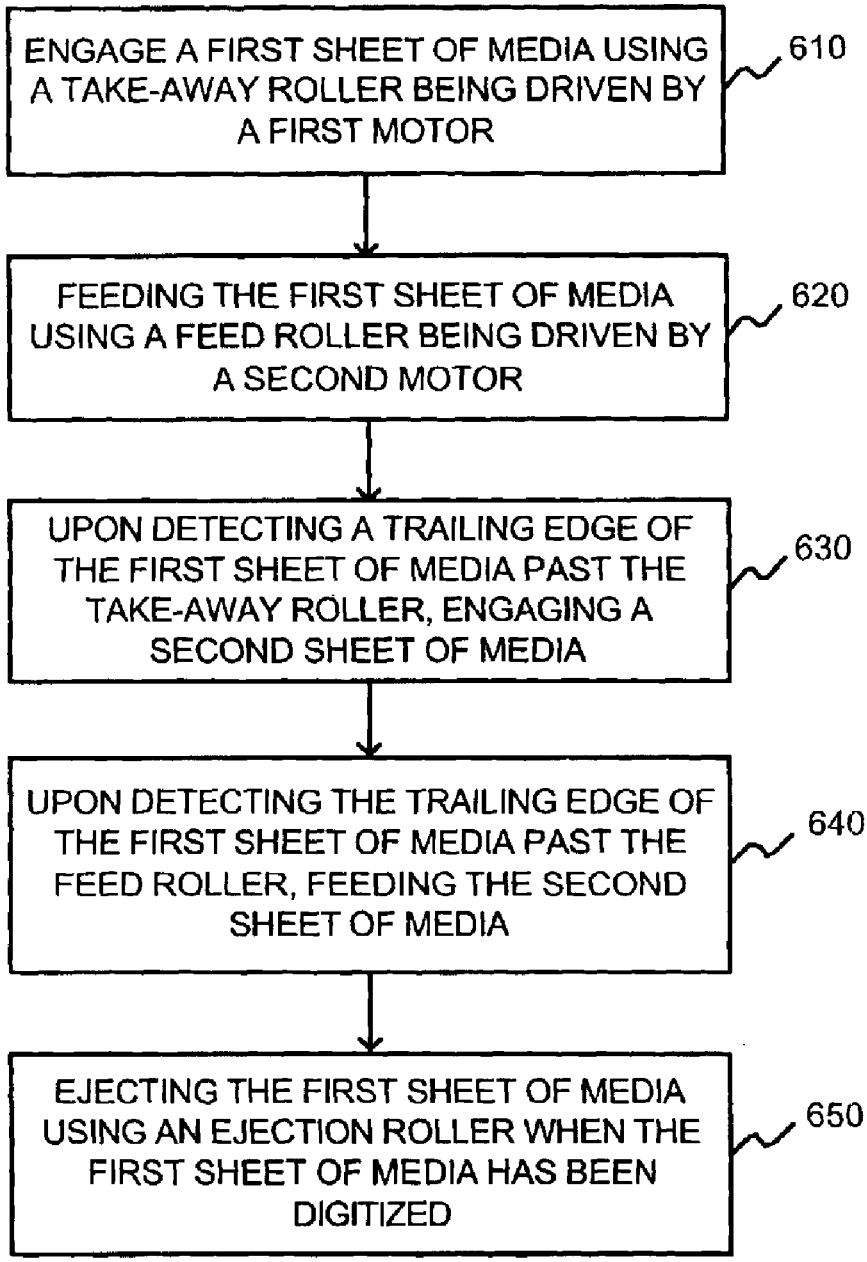
FIG. 6 shows a flowchart of an exemplary method for feeding sheets of media to a media processor consistent with embodiments of the present invention.

FIG. 6 shows a flowchart of an exemplary method for feeding sheets of media to a media processor consistent with embodiments of the present invention. The method may include engaging a first sheet of media using a take-away roller being driven by a first motor (step 610). This may be accomplished, for example, using take-away roller 504 and a first motor 508 of FIG. 5. Additionally or alternatively, other components, for example, idler roller 510, may also be used.

The method may further include feeding the first sheet of media using a feed roller being driven by a second motor (step 620). The first sheet of media may be fed using, for example, a feed roller 512 and a second motor 516 of FIG. 5. Additionally or alternatively, other components, such as idler roller 518, may also be used.

Further, the method may include upon detecting a trailing edge of the first sheet of media past the take-away roller, engaging a second sheet of media (step 630). In one embodiment, first sensor 532 of FIG. 5 may be used for this purpose. Also, as used herein, the term "past" includes not only its ordinary meaning, but also a situation where the sheet of media is in-line with the take-away roller.

The method may further include upon detecting the trailing edge of the first sheet of film past the feed roller, feeding the second sheet of media (step 640). In one embodiment, a sensor, such as second sensor 534 of FIG. 5, may be used for this purpose. Also, as used herein the term "past" includes not only its ordinary meaning, but also a situation where the sheet of media is in-line with the feed roller.

Further, the method may include ejecting the first sheet of media using an ejection roller when the first sheet of media has been digitized. In one embodiment, ejection roller 520 (FIG. 5), alone or in conjunction with other components, may be used to eject the first sheet of media. The phrase "when the first sheet of media has been digitized" includes but is not limited to a time instant at which a sheet of media passes image line 530 of FIG. 5. Thus, for example, this phrase may include a situation where the sheet of media may need to be at least partially re-scanned before ejection.

Further, the ejection roller may be driven at a different rate of rotation from a rotation of the feed roller. This is because the rate of rotation of the feed roller may depend upon a rate of scanning or digitizing the sheet of media. But, once the sheet of media has been scanned or digitized, it might be ejected at a faster rate.

Additionally, the exemplary method of FIG. 6 may further include sending a signal to a processor upon detection of the trailing edge of the first sheet of media past the take-away roller. Moreover, the method may include activating the feed roller to engage the first sheet of media upon receiving a signal from the processor.

Figure 7:
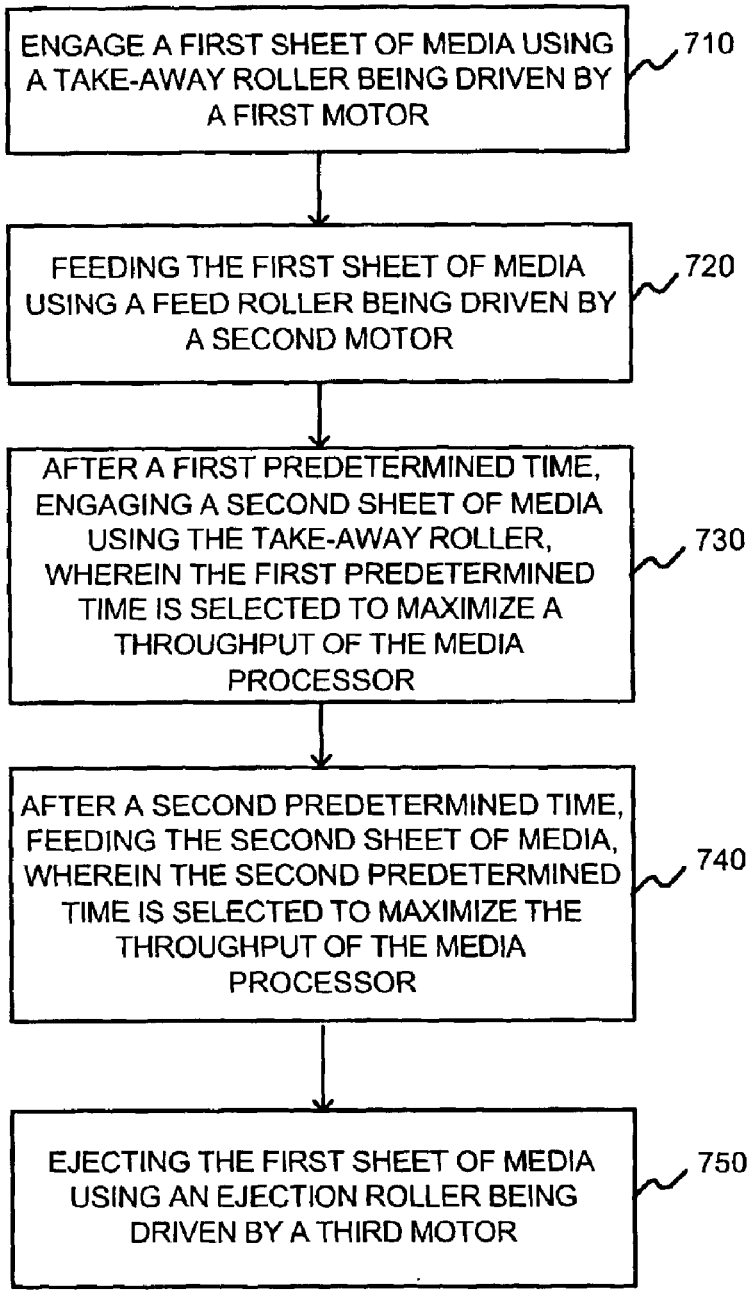
FIG. 7 shows a flowchart of an exemplary method for improving throughput of a media processor consistent with embodiments of the present invention.

FIG. 7 shows a flowchart of an exemplary method of improving throughput of a media processor consistent with embodiments of the present invention. The method may include engaging a first sheet of media using a take-away roller being driven by a first motor (step 710). This may be accomplished, for example, using the take-away roller 504 and a first motor 508 of FIG. 5. Additionally or alternatively, other components, for example, idler roller 510, may also be used.

The method may further include feeding the first sheet of media using a feed roller being driven by a second motor (step 720). The first sheet of media may be fed using, for example, a feed roller 512 and a second motor 516 of FIG. 5. Additionally or alternatively, other components, such as idler roller 518, may also be used.

Further, the method may include, after a first predetermined time, engaging a second sheet of media using the take-away roller, wherein the first predetermined time is selected to maximize the throughput of the media processor (step 730). The method may further include, after a second predetermined time, feeding the second sheet of media, wherein the second predetermined time is selected to maximize a throughput of the media processor (step 740).

Additionally, the method may include ejecting the first sheet of media using an ejection roller being driven by a third motor (step 750). In one embodiment, the ejection roller 520 (FIG. 5), alone or in conjunction with other components, may be used to eject the first sheet of media.

Figure 8:
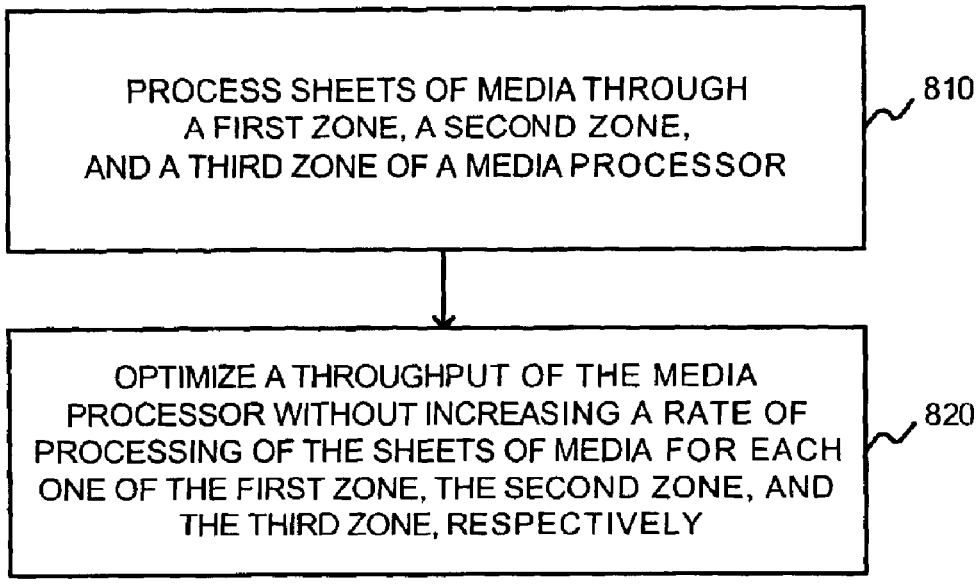
FIG. 8 shows a flowchart of another exemplary method for improving throughput of a media processor consistent with embodiments of the present invention.

FIG. 8 shows a flowchart corresponding to an exemplary method for optimizing a throughput of a media processor. The method may include processing sheets of media in a first direction through a first zone of a media processor, a second zone of a media processor, and a third zone of a media processor (step 810). In one embodiment, the first zone may relate to engaging a sheet of media and preparing the sheet of media for feeding the sheet of media to the media processor. The sheet of media may be engaged using a take-away mechanism (for example, roller 118 of FIG. 1A).

Thus, the first zone may comprise the taking away of the sheet of media up to the point at which the sheet of media is acquired by a feed mechanism, for example. The second zone may relate to feeding a sheet of media to the media processor and preparing the sheet of media for ejection by the media processor. Thus, the second zone may include the acquisition of the sheet of media by the feed mechanism up to the point at which the sheet of media is acquired by an ejection mechanism. The third zone may relate to ejecting the sheet of media. Thus, the third zone may comprise the acquisition of the sheet of media by the ejection mechanism up to the point at which the sheet of media is completely ejected.

The method may further include optimizing a throughput of the media processor without increasing a rate of processing of individual sheets of media through the first zone, the second zone, and the third zone, respectively (step 820). In one embodiment, a microprocessor under the control of a program (located in a ROM, a RAM, or any other type of memory) may receive information concerning the status of all sheets of media being processed by the media processor. Such information may include, but is not limited to, information concerning the location of a trailing edge and a leading edge of each of the sheets of media being processed by the media processor. By analyzing this information, the microprocessor may control the operation of a motor or motors that may in turn control the various processing zones. Thus, for example, once a sensor may detect the passage of a sheet of media past the first zone, the microprocessor may send a signal to a motor or another source of power associated with the first zone to, for example, engage the next sheet of media. But, the engaged sheet of media may not be taken up by the second zone until the second zone is ready to process the engaged sheet of media. The readiness may be ascertained by using a sensor, which may indicate to the microprocessor a state of a sheet of media being processed by the second zone.

In one embodiment, the media processor may further include a fourth processing zone. The fourth processing zone may relate to picking up a sheet of media and preparing the sheet of media for engagement by a take-away mechanism. The sheet of media may be picked up using any known pick-up mechanisms. Also, any of the pick-up mechanisms described in another patent application entitled "Apparatus and Methods for Separating a Sheet of Media from Other Sheets of Media for Feeding the Separated Sheet of Media to a Media Processor," which is incorporated by reference in its entirety, may also be used consistent with the present invention.

Additionally, optimizing the throughput of the media processor may also include maximizing the throughput of the media processor.

Other modifications and embodiments of the invention will be apparent to those skilled in the art from consideration of the specification and practice of the invention disclosed herein.

What is claimed is:

1. A method for feeding media to a media processor, comprising:

engaging a first sheet of media using a take-away roller being driven by a first motor;

feeding the first sheet of media using a feed roller being driven by a second motor;

upon detecting a trailing edge of the first sheet of media past the take-away roller, engaging a second sheet of media;

upon detecting the trailing edge of the first sheet of media past the feed roller, feeding the second sheet of media; and ejecting the first sheet of media using an ejection roller when the first sheet of media has been digitized.

2. The method of claim 1, wherein the ejection roller is being driven at a different rate of rotation from a rate of rotation of the feed roller.

3. The method of claim 1, further comprising:

sending a signal to a processor upon detection of the trailing edge of the first sheet of media past the take-away roller.

* * * * *

UNITED STATES PATENT AND TRADEMARK OFFICE

CERTIFICATE OF CORRECTION

PATENT NO. : 6,923,437 B2
DATED : August 2, 2005
INVENTOR(S) : Huang et al.

It is certified that error appears in the above-identified patent and that said Letters Patent is hereby corrected as shown below:

Column 10,
Line 40, insert claim 4:
-- 4. The method of claim 3, further comprising:
activating the feed roller to engage the first sheet of media. --.

Signed and Sealed this

Twentieth Day of December, 2005

JON W. DUDAS
*Director of the United States Patent and Trademark Office*